US008265499B2

(12) United States Patent
Sueoka

(10) Patent No.: US 8,265,499 B2
(45) Date of Patent: Sep. 11, 2012

(54) IMAGE FORMING APPARATUS HAVING TRANSFER MEMBER BIAS CONTROL

(75) Inventor: Takenori Sueoka, Tsukuba (JP)

(73) Assignee: Canon Kabushiki Kaisha, Tokyo (JP)

( * ) Notice: Subject to any disclaimer, the term of this patent is extended or adjusted under 35 U.S.C. 154(b) by 408 days.

(21) Appl. No.: 12/704,838

(22) Filed: Feb. 12, 2010

(65) Prior Publication Data

US 2010/0209128 A1 Aug. 19, 2010

(30) Foreign Application Priority Data

Feb. 19, 2009 (JP) ..... 2009-036685

(51) Int. Cl.
*G03G 15/16* (2006.01)

(52) U.S. Cl. ..... 399/45; 399/66

(58) Field of Classification Search ..... 399/44, 399/45, 66, 298, 302, 313, 314
See application file for complete search history.

(56) References Cited

U.S. PATENT DOCUMENTS

| | | | | |
|---|---|---|---|---|
| 5,915,145 | A * | 6/1999 | Shimura et al. | 399/66 |
| 5,999,760 | A * | 12/1999 | Suzuki et al. | 399/45 |
| 6,281,963 | B1 | 8/2001 | Takahata et al. | |
| 6,947,679 | B2 | 9/2005 | Kato et al. | |
| 2004/0253015 | A1 * | 12/2004 | Kitajima | 399/66 |
| 2005/0141911 | A1 * | 6/2005 | Nakaso | 399/66 |
| 2007/0201888 | A1 | 8/2007 | Izumi et al. | |

FOREIGN PATENT DOCUMENTS

| | | | |
|---|---|---|---|
| JP | 02287380 | A * | 11/1990 |
| JP | 05107834 | A * | 4/1993 |
| JP | 10-48965 | A | 2/1998 |
| JP | 11-288184 | A | 10/1999 |
| JP | 2002-156847 | A | 5/2002 |
| JP | 2004-117920 | A | 4/2004 |

* cited by examiner

*Primary Examiner* — Robert Beatty
(74) *Attorney, Agent, or Firm* — Fitzpatrick, Cella, Harper & Scinto

(57) ABSTRACT

Constant current control is performed with a target current It in each delivery interval between recording materials to sample a control voltage V1 applied to a secondary transfer roller. A transition to the constant current control with the target current It is made after a recording material divided voltage according to a kind of the recording material is applied to the constant voltage V1 at a head of the recording material. A voltage in which 0.9 is multiplied by addition of the sampled control voltage V1 and the recording material divided voltage Vp according to the kind of the recording material is set to a lower limit value Vlimit to perform the constant current control, and the constant voltage Vlimit is applied to the secondary transfer roller when a control voltage is lower than the lower limit value Vlimit in a calculation stage.

6 Claims, 16 Drawing Sheets

NORMAL TEMPERATURE
AND NORMAL HUMIDITY

HIGH TEMPERATURE
AND HIGH HUMIDITY

NEW STATE OF SECONDARY TRANSFER ROLLER

AT THE END OF LIFE OF SECONDARY TRANSFER ROLLER

NEW STATE OF SECONDARY TRANSFER ROLLER

AT THE END OF LIFE OF SECONDARY TRANSFER ROLLER

IMAGE FORMING APPARATUS HAVING TRANSFER MEMBER BIAS CONTROL

BACKGROUND OF THE INVENTION

1. Field of the Invention

The present invention relates to an image forming apparatus in which constant current control is performed to a transfer voltage used to transfer a toner image borne by an image bearing member or an intermediate transfer member to a recording material, particularly to a method for setting a constant voltage of a lower limit value of the transfer voltage to which the constant current control is performed.

2. Description of the Related Art

An image forming apparatus in which the toner image formed on the image bearing member is transferred to the recording material passing through a transfer portion and an image forming apparatus in which the toner image transferred to the intermediate transfer member is transferred to the recording material passing through the transfer portion are widely used.

In the image forming apparatus, the toner image is transferred to the recording material by applying the transfer voltage to the transfer portion in which a transfer member abuts on the image bearing member or the intermediate transfer member, and the transfer voltage that is of a constant voltage determined according to a predetermined transfer current value is generally applied to the transfer portion. This is because, as described later, when the constant current control is performed to the transfer voltage, a current passed through the outside of the recording material or a portion in which the toner image does not exist on the recording material makes a value of a current passed through the necessary toner image uncertain (see FIGS. 4A and 4B). Also, when the constant voltage is applied, the transfer current can be secured in the necessary toner image according to the constant voltage irrespective of the current passed through the outside of the recording material or the portion in which the toner image does not exist on the recording material.

However, a transfer member constituting the transfer portion largely varies according to a variation of a product, a member temperature, and an accumulated use time, and a resistance value of the recording material passing through the transfer portion varies according to a kind of the recording material, environmental humidity, and a humid state of the recording material.

Therefore, when the constant voltage control is performed to the transfer voltage, electric characteristics (such as resistance value) of the transfer member are measured to adjust the constant voltage in starting up the image forming apparatus or at the beginning of continuous image formation.

For example, Japanese Patent Application Laid-Open No. 2004-117920 discloses an image forming apparatus in which a constant voltage is applied to a transfer member to transfer a toner image borne by an intermediate transfer belt to a recording material. In this case, a predetermined voltage is applied to a transfer portion in which the recording material does not exist immediately before the continuous image formation is started, a current value is taken to obtain a voltage value corresponding to a predetermined target current, and a recording material divided voltage according to the kind of the recording material is added to the voltage value to set the constant voltage.

However, because a transfer member resistance value gradually decreases by temperature rise during the continuous image formation, the constant voltage that is proper immediately before the continuous image formation is started possibly to become improper. Also, when a humid state varies in each recording material even if the same kind of the recording material is delivered, the recording material resistance value changes, whereby the constant voltage that is proper in the first recording material possibly becomes improper in the 50th recording material.

Therefore, there is proposed a technique of re-measuring the transfer member resistance value in each ten sheets during the continuous image formation to re-adjust the constant voltage. However, a delivery interval between the recording materials expands to lower productivity of the continuous image formation, or image density changes in a stepwise manner before and after the re-adjustment. The technique therefore cannot deal with the variation of the humid state in each recording material at all.

On the other hand, when the constant current control is performed to the transfer voltage applied to the transfer portion, all the recording materials are automatically adjusted to the transfer current, in real time during the continuous image formation, according to the transfer member and the recording material resistance value. Therefore, the productivity of the continuous image formation is not lowered, the image density does not change in the stepwise manner, and the variation of the humid state in each recording material can be dealt with.

Japanese Patent Application Laid-Open Nos. 10-48965 and 11-288184 discloses an image forming apparatus in which a voltage to which constant current control is performed is applied to a transfer member to transfer a toner image borne by an intermediate transfer belt to a recording material. In this case, in order to avoid the drawback (the current value passed through the portion in which the toner image exists becomes uncertain) of the constant current control, a lower limit value is set to the voltage applied in the constant current control. The constant voltage of the lower limit value is therefore applied to the transfer member in the range where the voltage applied to the transfer member becomes lower than the lower limit value.

In the control disclosed in Japanese Patent Application Laid-Open No. 10-48965, the constant voltage is applied to the transfer member in the range where the voltage applied in the constant current control becomes lower than the lower limit value, so that at least a certain current value passed through the portion in which the toner image exists can be secured even if the recording material absorbs moisture to extremely lower the resistance value.

However, it was turned out that because the lower limit value of the voltage applied in the constant current control is a fixed value, the lower limit value becomes gradually improper when the transfer member resistance value increases continuously according to the accumulation of use time, and finally the lower limit value does not fulfill the function. It was turned out that the range to which the constant voltage is applied moves to the outside of the variation range of the recording material resistance value, and the constant voltage is not applied to the recording material that absorbs the moisture to extremely lower the resistance value (see FIGS. 5A and 5B).

SUMMARY OF THE INVENTION

The present invention provides an image forming apparatus in which the lower limit value of the range to which the constant current control is applied is properly set even if the transfer member resistance value changes. The present invention also provides an image forming apparatus including: an image bearing member; a toner image forming unit that forms a toner image on the image bearing member; a transfer member that forms a transfer portion, the transfer portion transferring the toner image from the image bearing member to a recording material; a control unit that performs constant current control in a transfer process such that an amount of current passes through the transfer member becomes a previously set target current value in a voltage range, a lower limit voltage that becomes a lower limit of an absolute value of a voltage applied to the transfer member being set in the voltage range; and a setting portion that sets the lower limit voltage based on a value obtained by adding a first voltage value and a second voltage value, the first voltage value being set by applying a voltage to the transfer member in a state in which the recording material does not exist in the transfer member, the second voltage value being set according to the recording material.

Further features of the present invention will become apparent from the following description of exemplary embodiments (with reference to the attached drawings).

DESCRIPTION OF THE EMBODIMENTS

An exemplary embodiment of the invention will be described in detail with reference to the drawings. The invention can be implemented in another embodiment in which part or the whole of the configuration of the embodiment is replaced with an alternative configuration as long as the lower limit value of the range to which the constant current control is applied varies according to the change in resistance of the transfer member.

Accordingly, the invention can also be implemented in an image forming apparatus in which the toner image is transferred from the image bearing member to the recording material borne by the recording material conveying member. The invention can be implemented in not only a tandem type full-color image forming apparatus but also one-drum type full-color image forming apparatus and a monochrome image forming apparatus.

Although only a main part relating to toner image formation/transfer is described in the embodiment, the invention can be implemented in various applications such as a printer, various printing machines, a copying machine, FAX, and a multifunction peripheral by applying necessary devices, equipment, and chassis structure.

Illustrations of general items of the image forming apparatus disclosed in Japanese Patent Application Laid-Open Nos. 2004-117920, 10-48965, and 11-288184 and overlapping description are omitted.

(Image Forming Apparatus)

Figure 1:
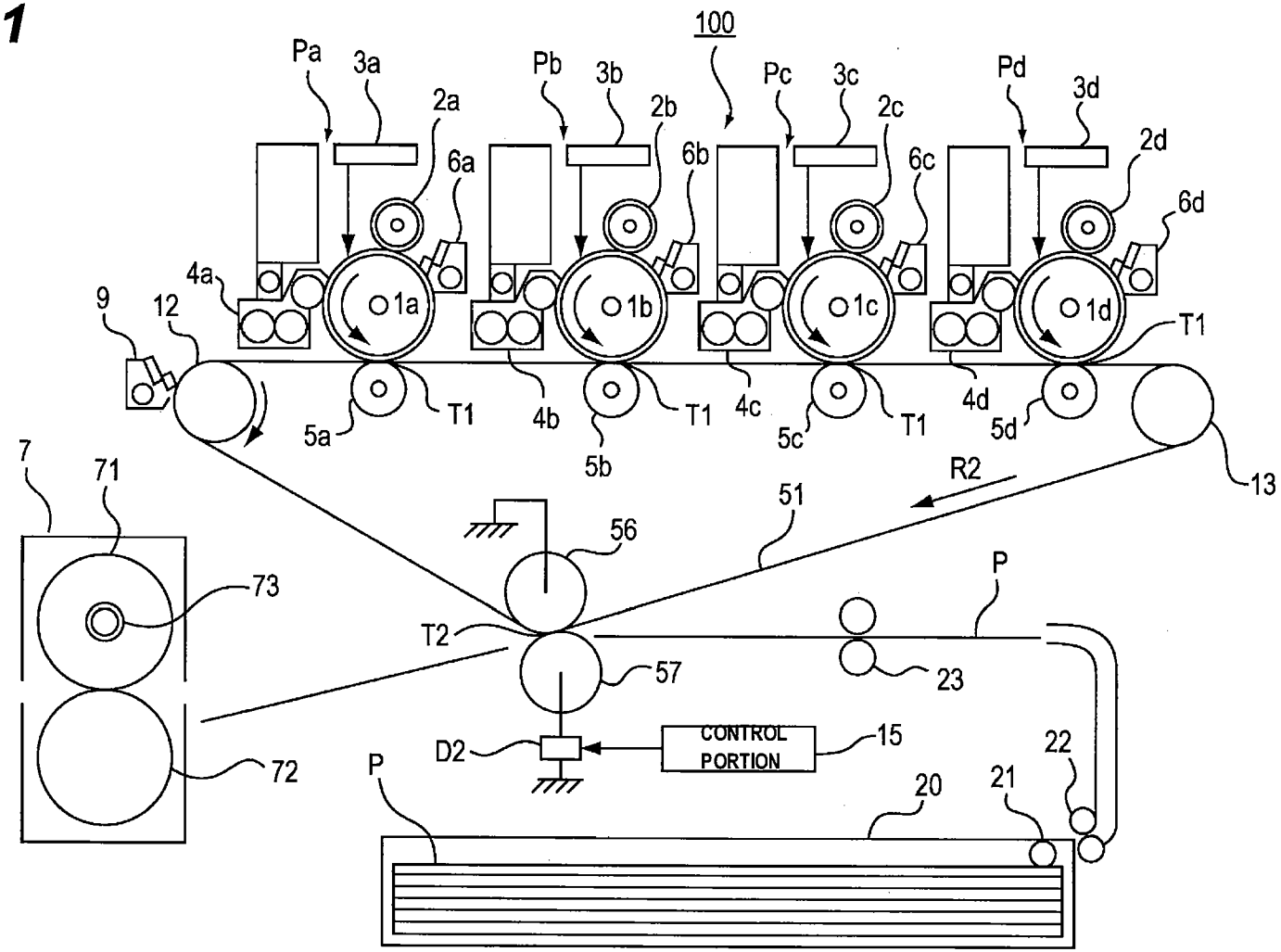
FIG. 1 illustrates a configuration of an image forming apparatus according to a first embodiment of the invention.
Figure 2:
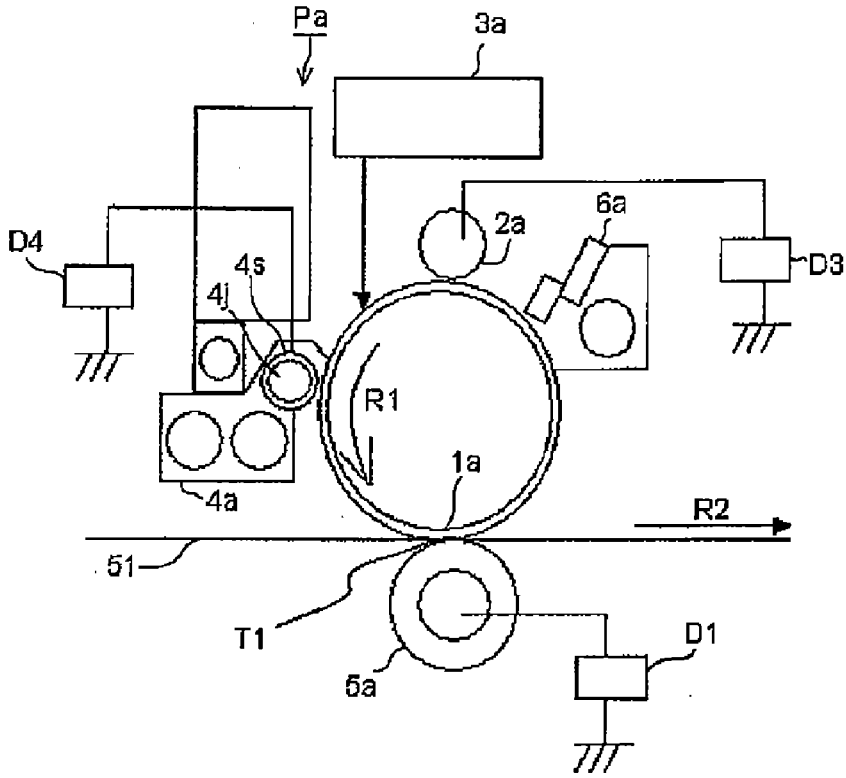
FIG. 2 illustrates a configuration of an image forming portion.

FIG. 1 illustrates a configuration of an image forming apparatus according to a first embodiment of the invention, and FIG. 2 illustrates a configuration of an image forming portion.

As illustrated in FIG. 1, an image forming apparatus 100 is a tandem type intermediate transfer system full-color copying machine in which image forming portions Pa, Pb, Pc, and Pd are arrayed along an intermediate transfer belt 51.

In the image forming portion Pa that is of an example of the toner image forming unit, a yellow toner image is formed in a photosensitive drum 1*a* and primary-transferred to the intermediate transfer belt 51. In the image forming portion Pb, a magenta toner image is formed in a photosensitive drum 1*b*, and primary-transferred while superimposed on the yellow toner image of the intermediate transfer belt 51. In the image forming portions Pc and Pd, a cyan toner image and a black toner image are formed on photosensitive drums 1*c* and 1*d*, respectively, and the images are sequentially primary-transferred while superimposed on the intermediate transfer belt 51.

The four color toner images primary-transferred to the intermediate transfer belt 51 are conveyed to a secondary transfer portion T2 and collectively secondary-transferred to a recording material P. The recording material P to which the four color toner images are secondary-transferred is discharged to the outside of the image forming apparatus 100 after a fixing device 7 heats and pressurizes the recording material P to fix the toner images to a surface of the recording material P.

The intermediate transfer belt 51 is supported while entrained about a tension roller 12, a drive roller 13, and a counter roller 56, and t then driven by the drive roller 13 to rotate in a direction of an arrow R2 at a predetermined process speed. The tension roller 12 provides a tension of 30N (3 kgf) to the intermediate transfer belt 51.

A separation device 22 separates one-by-one the recording materials P that are taken out from a recording material cassette 20 by a pickup roller 21, and the separation device 22 delivers the recording material P to a registration roller 23.

The registration roller 23 in a stopped state receives the recording material P, and puts the recording material P in a stand-by state. The registration roller 23 then delivers the recording material P to the secondary transfer portion T2 in synchronization with the toner image of the intermediate transfer belt 51.

A belt cleaning device 9 causes a cleaning blade to slide and scrape on the intermediate transfer belt 51 to remove transfer residual toner that passes through the secondary transfer portion T2 and remains on the intermediate transfer belt 51.

In the fixing device 7, a heating nip is formed by pressing a pressure roller 72 against a fixing roller 71 provided in a heater 73. In a process for nipping and conveying the recording material P by the heating nip, the recording material P is subjected to the heat and pressure to melt the toner image, thereby fixing the full-color image to the surface of the recording material P.

The image forming portions Pa, Pb, Pc, and Pd have the substantially same configuration except that yellow, magenta, cyan, and black toner colors are used in the development devices 4*a*, 4*b*, 4*c*, and 4*d*. Hereinafter, only the image forming portion Pa is described, and it is assumed that other image forming portions Pb, Pc, and Pd are described by replacing the letter a at the end of the numeral in the description with letters b, c, and d.

As illustrated in FIG. 2, in the image forming portion Pa, a charging roller 2*a*, an exposure device 3*a*, a development device 4*a*, a primary transfer roller 5*a*, and a cleaning device 6*a* are disposed around the photosensitive drum 1*a*.

In the photosensitive drum 1*a*, a negatively charged photosensitive layer is formed in an outer circumferential surface of an aluminum cylinder. A drive motor (not illustrated) transmits a driving force to the photosensitive drum 1*a*, and the photosensitive drum 1*a* rotates in the direction of an arrow R1 at the predetermined process speed.

The charging roller 2*a* is driven rotated while abutting on the photosensitive drum 1*a*, and a power supply D3 applies a vibration voltage in which an alternating-current voltage is superimposed on a direct-current voltage to the charging roller 2*a*, whereby the charging roller 2*a* evenly charges the surface of the photosensitive drum 1*a* to a negative potential.

A laser beam scans over the exposure device 3*a* with a rotary mirror to write an electrostatic image of the image on the surface of the charged photosensitive drum 1*a*. In the laser beam, ON-OFF modulation is performed to scanning line image data in which yellow separation color image is spread out.

In the development device 4*a*, a two-component developer is stirred and charged, a development sleeve 4*s* bears the two-component developer, and the photosensitive drum 1*a* slides and scrapes on the development sleeve 4*s*. The development sleeve 4*s* rotates around a fixed magnetic pole 4*j* in a direction opposite to the rotating direction of the photosensitive drum 1*a*. When a power supply D4 applies a vibration voltage in which the alternating-current voltage is superimposed on the negative direct-current voltage, negatively charged toner moves to the electrostatic image of the photosensitive drum 1*a* that is positively charged relative to the development sleeve 4*s*, thereby performing inverse development of the electrostatic image.

The primary transfer roller 5*a* presses the intermediate transfer belt 51 to form a primary transfer portion T1 between the photosensitive drum 1*a* and the intermediate transfer belt 51. A power supply D1 applies the positive direct-current voltage to the primary transfer roller 5*a*, whereby the negatively charged toner image borne by the photosensitive drum 1*a* is primary-transferred to the intermediate transfer belt 51 passing through the primary transfer portion T1.

The cleaning device 6*a* causes the cleaning blade to slide and scrape on the photosensitive drum 1*a* to remove transfer residual toner that passes through the primary transfer portion T1 and remains on the photosensitive drum 1*a*.

(Transfer Portion)

Figure 3:
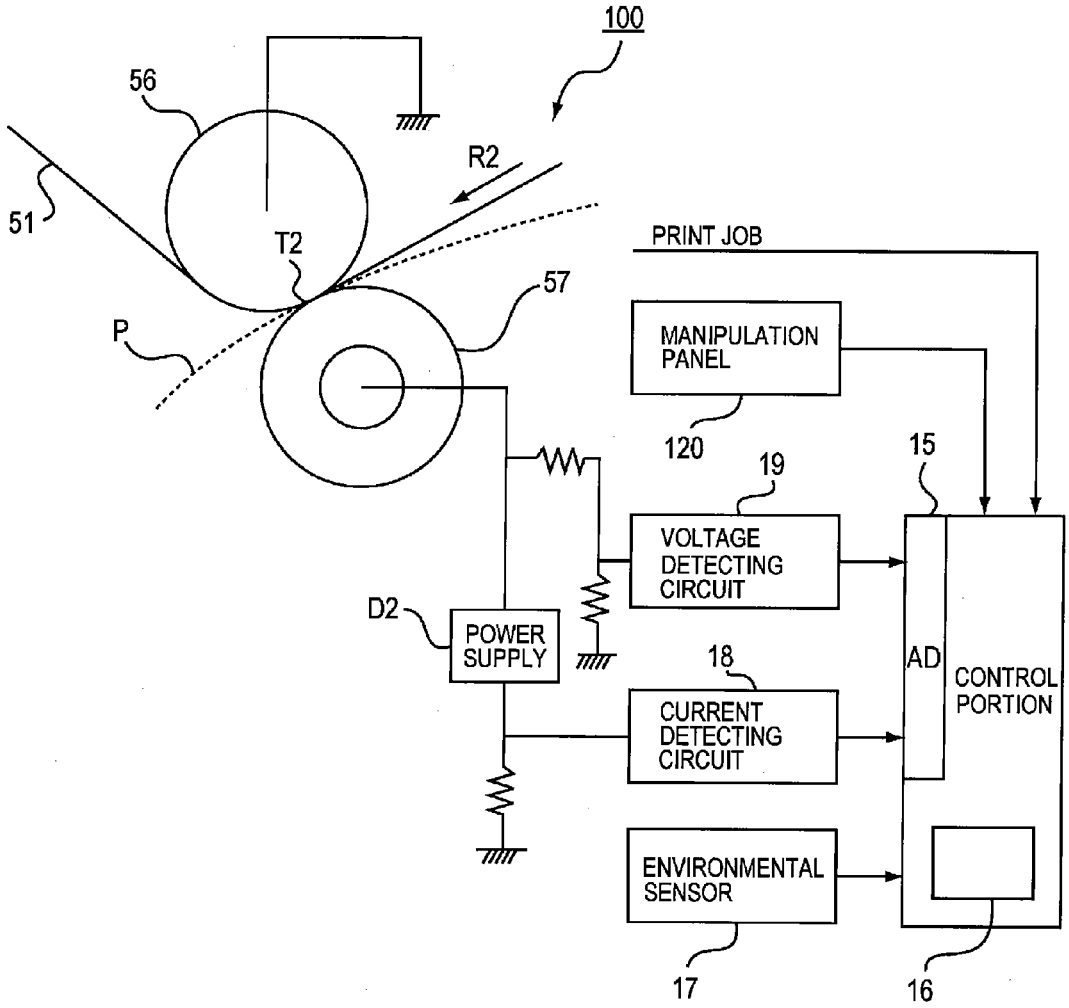
FIG. 3 illustrates a configuration of a secondary transfer portion.
Figure 4A:
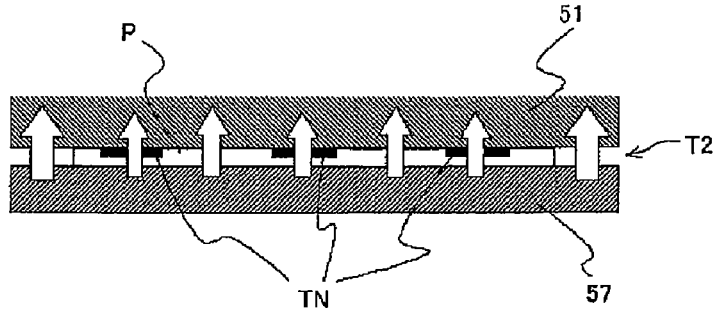
FIG. 4A PRIOR ART
FIGS. 4A and 4B illustrate a problem of constant current control.
Figure 4B:
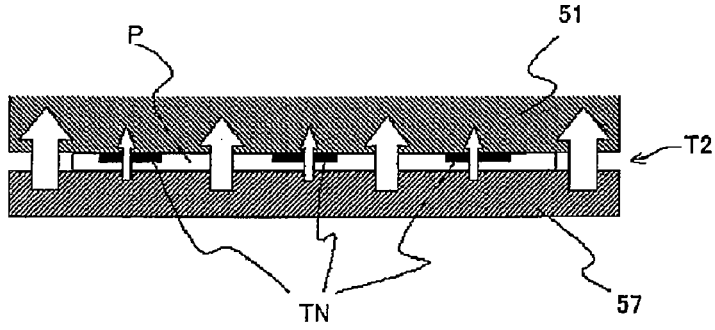
FIG. 4B PRIOR ART
Figure 5A:
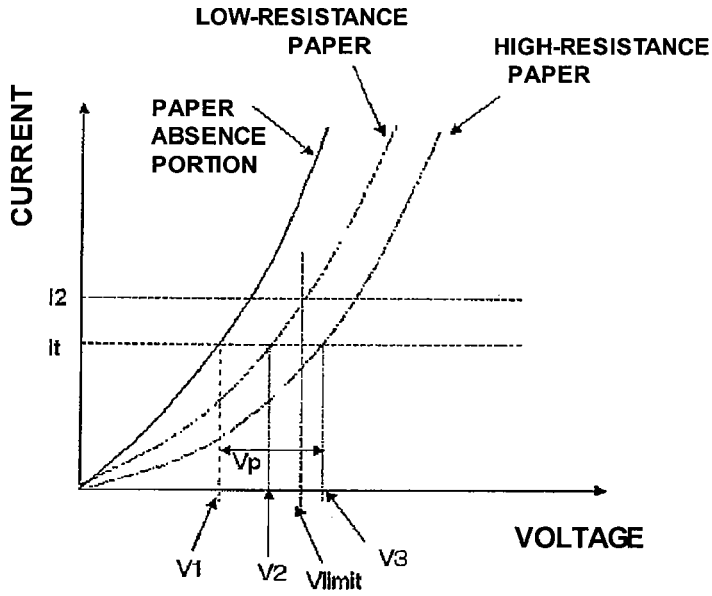
FIG. 5A PRIOR ART
FIGS. 5A and 5B illustrate a problem when a lower limit value of the constant current control is a fixed value.
Figure 5B:
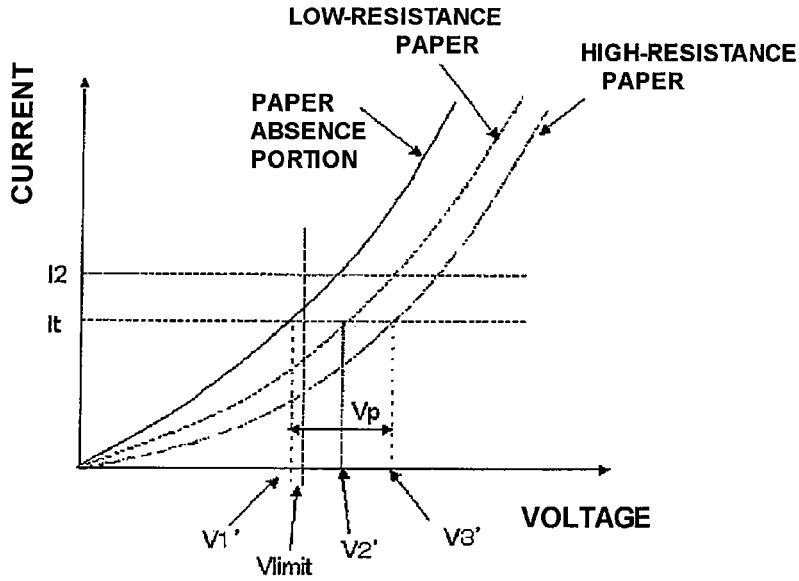
FIG. 5B PRIOR ART

FIG. 3 illustrates a configuration of a secondary transfer portion, FIGS. 4A and 4B illustrate a problem of constant current control, and FIGS. 5A and 5B illustrate a problem when a lower limit value of the constant current control is a fixed value.

A secondary transfer roller 57 is pressed against the intermediate transfer belt 51 whose inner side face is supported by a counter roller 56 connected to a ground potential, thereby forming the secondary transfer portion T2 between the intermediate transfer belt 51 and the secondary transfer roller 57. When the power supply D2 applies the positive direct-current voltage to the secondary transfer roller 57, a transfer electric field is formed in the secondary transfer portion T2, whereby the negatively charged toner image borne by the intermediate transfer belt 51 is secondary-transferred to the recording material P passing through the secondary transfer portion T2.

The intermediate transfer belt 51 is made of a film material having a thickness of 50 to 150 μm. In the film material, volume resistivity is adjusted in a range of $1\times10^{8}$ to $1\times10^{12}\Omega\cdot$cm by containing carbon black in dielectric resin such as polyimide. The intermediate transfer belt 51 having a width of 370 mm and a circumferential length of 900 mm is formed into an endless shape.

A conductive rubber layer having a thickness of 2 mm is formed on an outer circumference of an aluminum pipe having a diameter of 18 mm, thereby producing the counter roller 56 having an outer diameter of 22 mm. In the conductive rubber, an ion conductive agent is mixed in nitrile-butadiene rubber, ethylene-propylene-diene rubber, or urethane, thereby adjusting a resistance value of the counter roller 56 to $1\times10^{5}\Omega$ or less. The resistance value is obtained from a current passed through when the counter roller 56 is pressed against the conductive cylinder with 10N (1 kgf), and a voltage of 50V is applied to a roller shaft while the counter roller 56 is driven rotated by the rotation of the conductive cylinder. Surface hardness of the counter roller 56 is 70 degrees in terms of ASKER-C hardness value.

A conductive rubber sponge elastic layer having a thickness of 6 mm is formed on an outer circumference of a stainless roller shaft having a diameter of 12 mm, thereby producing the secondary transfer roller 57 having an outer diameter of 24 mm. In the conductive rubber sponge, the ion conductive agent is mixed in nitrile-butadiene rubber, ethylene-propylene-diene rubber, or urethane, thereby adjusting a resistance value of the secondary transfer roller 57 to $1\times10^{7}$ to $1\times10^{8}\Omega$. The resistance value is obtained from a current passed through when the secondary transfer roller 57 is pressed against the conductive cylinder with 10N (1 kgf), a voltage of 2 kV is applied to a roller shaft while the secondary transfer roller 57 is driven rotated by the rotation of the conductive cylinder. Surface hardness of the secondary transfer roller 57 is 35 degrees in terms of ASKER-C hardness value.

The resistance value (electric characteristics) of the secondary transfer roller 57 varies largely according to a variation of a product during production, a change in environmental temperature, and accumulation of use time. The resistance value of the recording material varies largely according to moisture absorption and drying. Therefore, in order to keep the transfer current passed through the recording material constant, preferably the constant current control is performed to the transfer voltage applied to the secondary transfer roller 57.

For example, the current passed through the transfer member is detected using a power supply that can provide a variable constant voltage, and the constant voltage may be set such that detected current becomes a target current value necessary to transfer the toner image. According to the control, fine control can be performed such that control in which the constant voltage control and the constant current control are mixed can be performed, and such that the constant voltage value and the constant current value can freely be set.

However, there is the following problem in the constant current control.

As illustrated in FIG. 4A, when the toner image is transferred from the intermediate transfer belt 51 to the recording material P in the longitudinal direction of the secondary transfer portion T2, it is necessary to secure the current passed through the portion in which the toner image exists on the recording material within a proper range. FIG. 4A schematically illustrates the current flow in the secondary transfer portion T2 viewed from the upstream side in the recording material conveying direction, and arrows indicates magnitude of the current passed through the secondary transfer portion T2 in each region.

However, the secondary transfer roller 57 comes into direct contact with the intermediate transfer belt 51 on the outside of the recording material P. Therefore, the resistance value in the portion in which the recording material P does not exist is lower than that in the portion in which the recording material P exists, and current density of the transfer current in the portion in which the recording material P does not exist is higher than that in the portion in which the recording material P exists. Also, the resistance value in the portion in which the toner does not exist on the recording material is higher than that in the portion in which the toner exists, and the current density of the transfer current in the portion in which the toner does not exist on the recording material is higher than that in the portion in which the toner exists.

Therefore, even in a normal-temperature and normal-humidity environment, the current density in the portion in which the toner image exists on the recording material is lower than average current density of the transfer current passed through the whole of the secondary transfer portion T2.

As illustrated in FIG. 4B, in the current density in the portion in which the toner image exists on the recording material, a high-temperature and high-humidity environment becomes further lower than that in the normal-temperature and normal-humidity environment. Because the temperature at the secondary transfer roller 57 rises to decrease the resistance value, the difference in resistance increases between the portion in which the recording material P exists (paper passing portion) and the portion in which the recording material P does not exist (paper non-passing portion). Because the recording material absorbs the moisture to decrease the resistance value, the difference in resistance increases between the portion in which the toner image exists (image portion) and the portion in which the toner image does not exist (non-image portion).

Therefore, even if the difference between the currents passed through the image portion and non-image portion is small in the normal-temperature and normal-humidity environment, the current concentrates on the paper non-passing portion or non-image portion, in which the resistance is low, and a ratio of the current passed through the image portion is reduced in the high-temperature and high-humidity environment. As a result, in the high-temperature and high-humidity environment, the toner image can insufficiently be transferred to easily generate a transfer defect due to transfer current shortage, that is, an image dropout (transfer fault).

Therefore, as illustrated in FIG. 5A, Japanese Patent Application Laid-Open No. 10-48965 has proposed the technique of providing the lower limit value (lower limit voltage) to the transfer voltage to which the constant current control is performed. FIG. 5A illustrates a relationship between the voltage applied to the secondary transfer roller 57 and the current passed through the secondary transfer portion T2.

In order to pass a current It necessary to transfer the toner image to the recording material P, a voltage V1 is applied to the secondary transfer roller 57 when no paper passes through. Whereas a voltage V2 is applied to the secondary transfer roller 57 when low-resistance paper (hygroscopic paper and the image having a low coverage rate) passes through, and a voltage V3 is applied to the secondary transfer roller 57 when high-resistance paper (nonhygroscopic paper and the image having the high coverage rate) passes through. At this point, a lower limit voltage Vlimit that is higher than the voltage V2 is set as a fixed value. When the voltage value necessary to pass the current It is lower than the lower limit voltage Vlimit due to the small resistance of the recording material P, the constant current control is switched to the constant voltage control to which the lower limit voltage Vlimit is applied. As a result, when the low-resistance paper passes through the secondary transfer portion T2, because a current I2 that is higher than the current It is passed, a large amount of current passed through the image portion can be secured compared with the case of constant current control, and the transfer fault can be prevented.

However, the resistance value of the secondary transfer roller 57 largely depends on not only the temperature and humidity, environment but also an energization accumulation time. Since the secondary transfer roller 57 uses the rubber material in which the ion conductive material is mixed, the resistance value tends to rise when the current having the same polarity is continuously applied. Therefore, the voltage value necessary to pass the target current increases as the number of accumulated sheets for the image formation increases to lengthen the energization accumulation time (accumulated use time).

As illustrated in FIG. 5B, when the number of accumulated sheets for the image formation increases to rise the resistance of the secondary transfer roller 57, the voltage applied to the secondary transfer roller 57 increases wholly in order to transfer the toner image to the recording material P. In order to pass the same current It through the secondary transfer portion T2, the voltage V1' is applied to the secondary transfer roller 57 when no paper passes through, the voltage V2' is applied to the secondary transfer roller 57 when the low-resistance paper (hygroscopic paper and the image having the low coverage rate) passes through, and a voltage V3' is applied to the secondary transfer roller 57 when the high-resistance paper (nonhygroscopic paper and the image having the high coverage rate) passes through.

Therefore, even if the resistance value of the recording material P decreases in the high-temperature and high-humidity environment, the voltage V2' applied to the secondary transfer roller 57 is not lower than the lower limit voltage Vlimit, and the constant current control is maintained without switching the constant current control to the constant voltage control. At this point, in the image in which a ratio of the non-image portion becomes high, a ratio of the current passed through the non-image portion increases, the current necessary to transfer the image portion is not supplied, and the transfer fault is easily generated.

In the following embodiment, a setting portion 15 performs the constant current control during the transfer process so that the current amount becomes a predetermined target current only when the absolute value of the voltage value applied to the transfer member 57 is equal to or more than the absolute value of the set lower limit voltage. The setting portion 15 then changes the absolute value of the lower limit value of the constant current control according to the resistance value of the secondary transfer roller 57. The resistance value of the secondary transfer roller 57 is measured by performing the constant current control using a test current immediately before the delivery interval. The reason the absolute value is used is that the transfer voltage has both the positive polarity and the negative polarity, and the invention is used for both control.

That is, in order to measure the electric characteristics (such as resistance value) of the secondary transfer roller 57, the setting portion 15 provides the control voltage to which the constant current control is performed with the predetermined current value It from the power supply D2 before the recording material reaches the transfer portion. In the process in which the recording material passes through the transfer portion, the constant current control is performed within a voltage range where a constant voltage output is set as the lower limit value. In the constant voltage output, a predetermined ratio is multiplied by addition of the control voltage that is measured before the recording material reaches and a constant voltage output that is previously prepared according to the kind of the recording material.

Therefore, even if the resistance value of the secondary transfer roller 57 varies in the long term or the short term, the lower limit value of the constant current control can be set within the resistance value range according to a hygroscopic degree of the recording material P. For the recording material P having the hygroscopic degree that is more than a certain value, the current necessary for the transfer can be secured in the portion in which the toner image exists in the recording material by applying the constant voltage instead of the constant current control.

EXAMPLE 1

Figure 6:
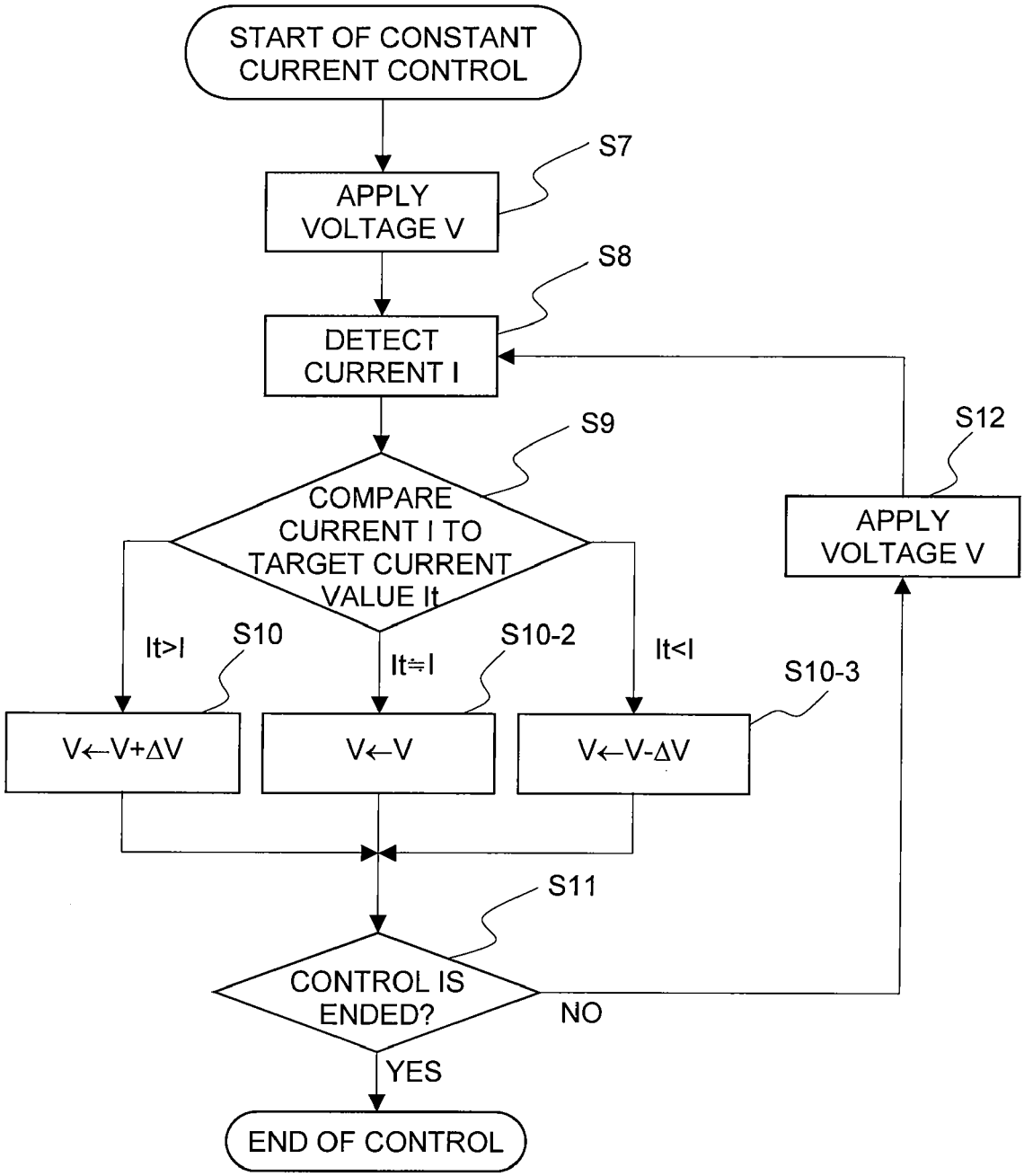
FIG. 6 is a flowchart illustrating control of a voltage applied during the constant current control.
Figure 7:
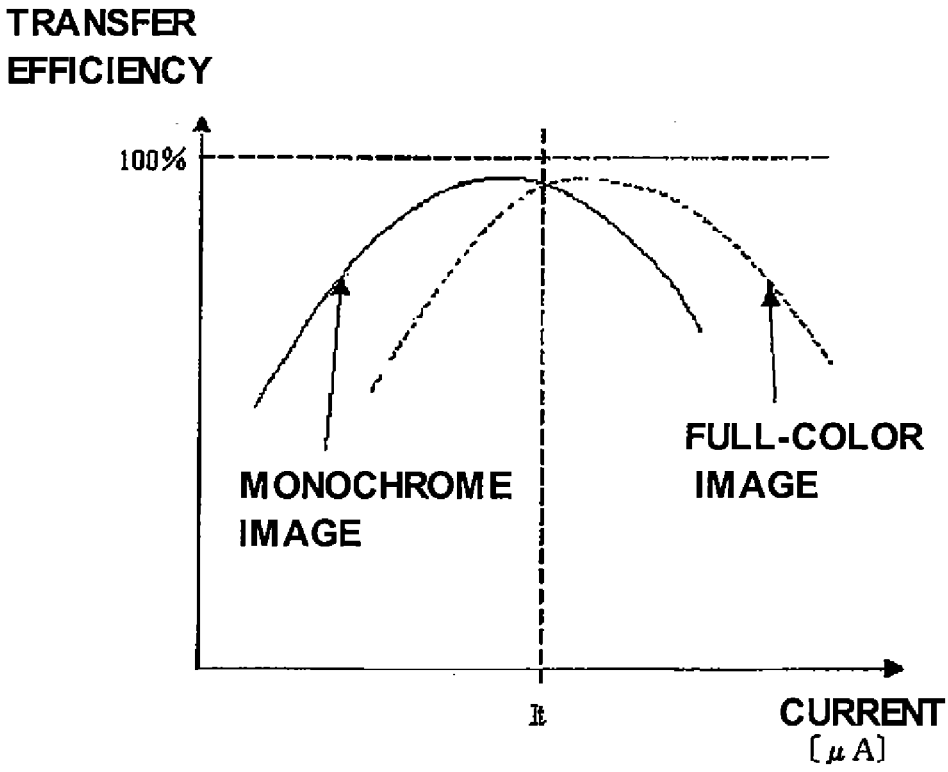
FIG. 7 illustrates a current necessary to transfer a toner image.
Figure 8:
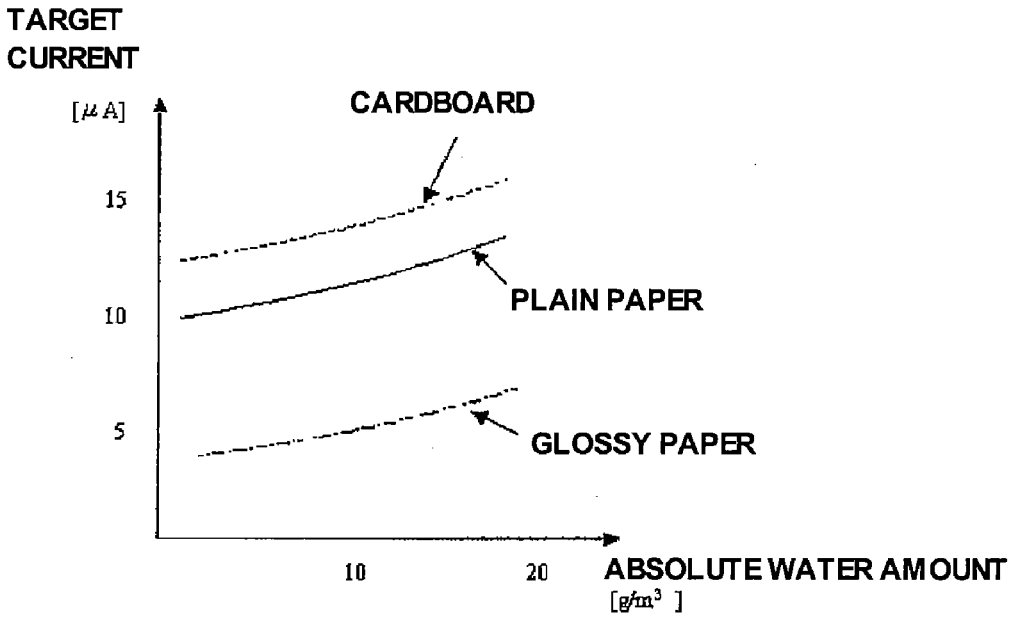
FIG. 8 illustrates a target current value according to a kind of a recording material.
Figure 9:
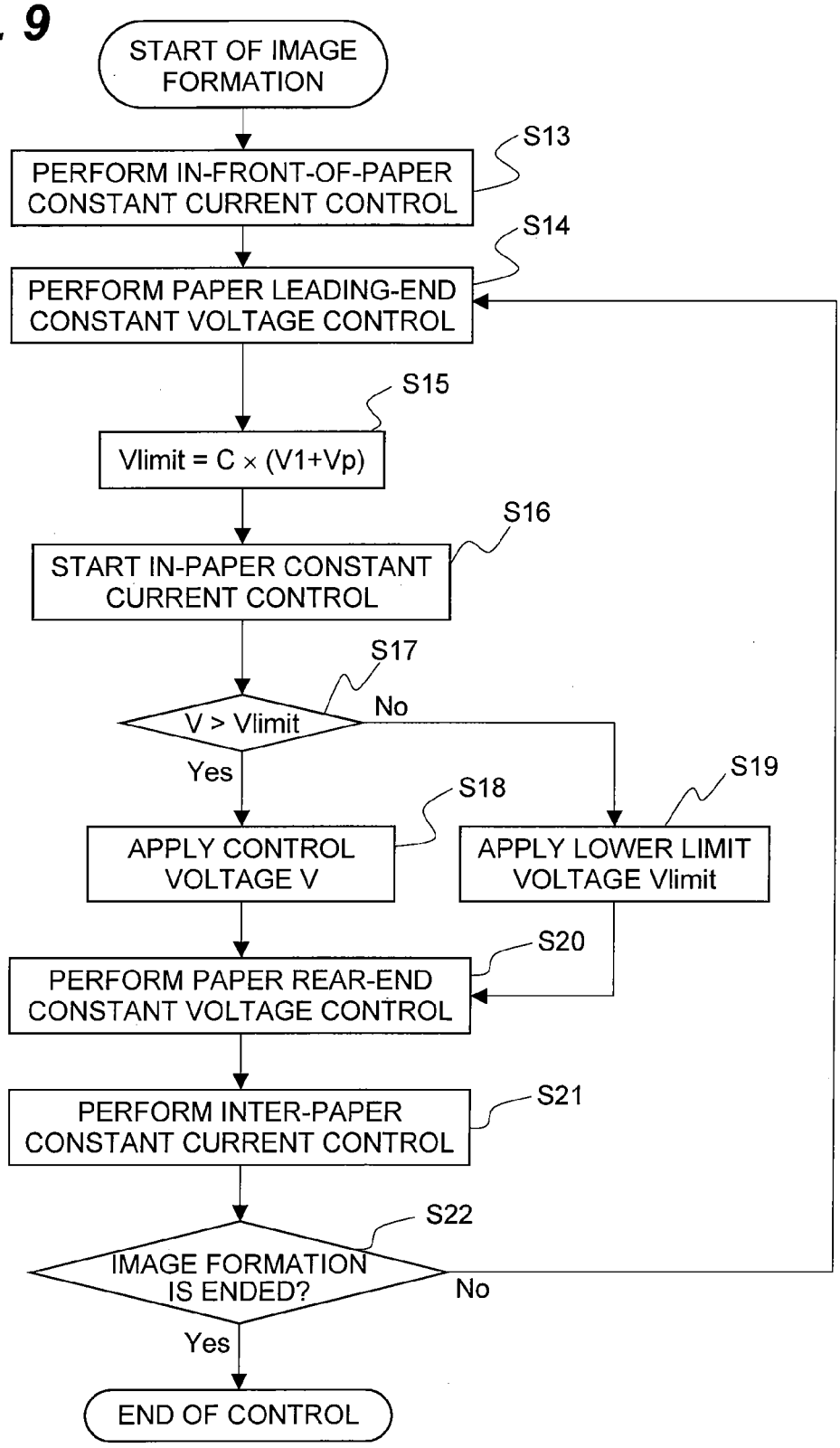
FIG. 9 is a flowchart illustrating control of a transfer voltage in Example 1.
Figure 10:
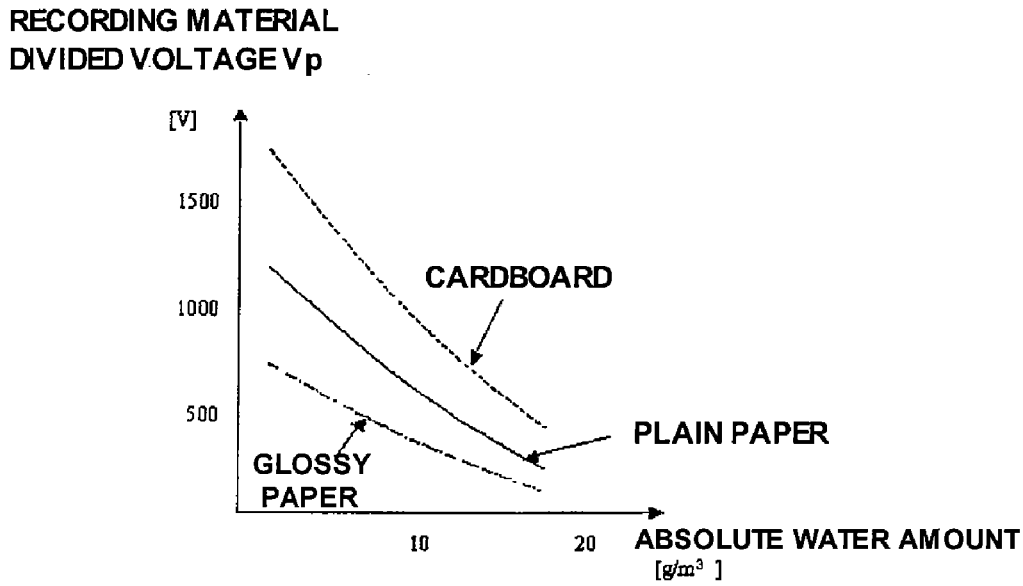
FIG. 10 illustrates a recording material divided voltage.
Figure 11A:
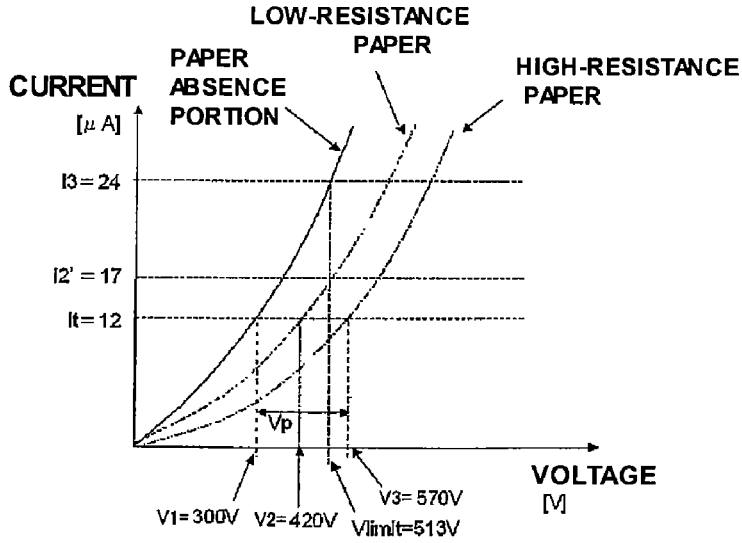
FIGS. 11A and 11B illustrate an effect of control of Example 1.
Figure 11B:
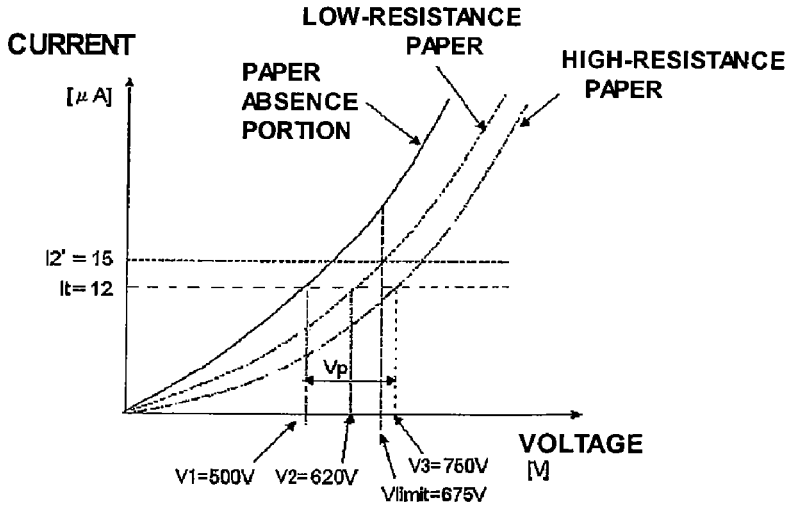

FIG. 6 is a flowchart illustrating control of a voltage applied during the constant current control, FIG. 7 illustrates a current necessary to transfer a toner image, and FIG. 8 illustrates a target current value according to a kind of a recording material. FIG. 9 is a flowchart illustrating control of a transfer voltage in Example 1, FIG. 10 illustrates a recording material divided voltage, and FIGS. 11A and 11B illustrate an effect of control of Example 1.

As illustrated in FIG. 3, the power supply D2 can apply the control voltage to which the constant current control is performed with the predetermined target current value It and the variable constant voltage to the secondary transfer roller 57 while the control voltage and the variable constant voltage are switched. The control portion (DC controller) 15 that is of an example of the control unit performs the constant current control during the transfer process such that the amount of current passed through the transfer member 57 becomes the predetermined target current. The control portion 15 controls the power supply D2 such that the power supply D2 is caused to provide "the control voltage applied during the constant current control" within the voltage range to the lower limit value to the secondary transfer roller 57, and to provide the constant voltage of the lower limit value within the range where the control voltage is lower than the lower limit value to the secondary transfer roller 57.

A current detecting circuit 18 detects the current that is supplied from the power supply D2 to the secondary transfer roller 57 and passed through the secondary transfer portion T2. The current detecting circuit 18 provides an analog voltage of 0 to 5V according to the current value, the control portion 15 performs A/D conversion of the analog voltage into an 8-bit digital signal, and the digital signal is fed into an operational circuit 16.

An environmental sensor 17 detects the temperature and humidity in the chassis of the image forming apparatus 100. The information on the temperature and humidity detected by the environmental sensor 17 is fed into the operational circuit 16 of the control portion 15.

A voltage detecting circuit 19 detects the voltage provided from the power supply D2 to the secondary transfer roller 57. The voltage detecting circuit 19 provides the analog voltage of 0 to 5V according to the voltage value, the control portion 15 performs A/D conversion of the analog voltage into an 8-bit digital signal, and the digital signal is fed into the operational circuit 16.

A manipulation panel 120 displays a recording material selection page for a user to select the kind of the recording material. The data specifying the kind of the recording material is added to a print job input from an external personal computer.

The control portion 15 recognizes manipulation contents of the manipulation panel 120 or the print job to determine whether the recording material used to form the image is plain paper, cardboard, or glossy paper.

As illustrated in FIG. 6 as referring to FIG. 3, the control portion 15 measures the electric characteristics of the secondary transfer roller 57, and controls the control voltage V applied to the secondary transfer roller 57 based on the measurement result.

When the power supply D2 provides the control voltage V (S7), the current detecting circuit 18 detects the current applied to the secondary transfer roller 57 to feed the detected current into the control portion 15 (S8).

The control portion 15 compares the current value detected by the current detecting circuit 18 and the previously set target current value It (S9).

As illustrated in FIG. 7, the transfer efficiency of the secondary transfer portion T2 changes according to the current passed through the secondary transfer roller 57. The transfer efficiency expresses how much percentage of the toner image on the intermediate transfer belt 51 can be transferred to the recording material, and the transfer efficiency becomes 100% when the whole of the toner image is completely transferred.

The transfer efficiency is lowered when an excessively large amount of current is passed through the secondary transfer roller 57 and when an excessively small amount of current is passed through the secondary transfer roller 57. As illustrated in the comparison of the monochrome image and the full-color image, the necessary current increases with increasing amount of toner to be transferred. Therefore, the target current value It is selected such that both the monochrome image and the full-color image can be transferred with the high transfer efficiency.

The relationship between the current passed through the secondary transfer roller 57 and the transfer efficiency depends on the charge of the toner, and the charge of the toner largely depends on the surrounding temperature and humidity environment. Therefore, different target current values are selected according to the temperature and humidity environment.

Because the relationship between the current passed through the secondary transfer roller 57 and the transfer efficiency depends on the resistance of the recording material, different target currents are selected according to the recording material.

As illustrated in FIG. 8, the control portion 15 sets the target current value according to an absolute water amount that is computed based on the temperature and humidity detected by the environmental sensor 17. The absolute water amount corresponds to about 10.5 g/m$^3$ at the temperature of 25° C. and humidity of 60%, about 1 g/m$^3$ at the temperature of 15° C. and humidity of 20%, and about 18 g/m$^3$ at the temperature of 30° C. and humidity of 80%.

The target current values of FIG. 8 are obtained for the recording material in which the resistance is not lowered by the moisture absorption. FIG. 8 illustrates the target currents of the plain paper, cardboard, and glossy paper, however, the target current can be set for other kinds of the recording materials and the recording materials having different grammages.

As illustrated in FIG. 6 as referring to FIG. 3, the control portion 15 sets a value in which a predetermined voltage width ΔV (35V) is added to the current control voltage V to the control voltage V when the difference between the target current value It and the current value detected by the current detecting circuit 18 becomes positive (S10-1).

The control portion 15 retains the current control voltage V when the difference between the target current value It and the current value becomes near zero (S10-2).

The control portion 15 sets a value in which the predetermined voltage width ΔV (35V) is subtracted from the current control voltage V to the control voltage V when the difference between the target current value It and the current value becomes negative (S10-3).

The control is continued until the difference between the target current value It and the current value becomes near zero (YES in S11), whereby the current passed through the secondary transfer roller 57 converges to the target current value, and the "voltage applied during the constant current control" is provided.

As illustrated in FIG. 9 as referring to FIG. 3, when the image formation is started, first the control portion 15 that is of an example of the setting unit performs in-front-of-paper constant current control (S13). At this point, as described above, the target current value It is determined according to the temperature and humidity detected by the environmental sensor 18 and the kind of the recording material.

In the in-front-of-paper constant current control (S13), the control portion 15 samples the control voltage V1 (first voltage value, paper absence portion voltage) at which the target current It can be passed through the secondary transfer portion T2 when the recording material P does not exist.

Then the control portion 15 performs paper leading-end constant voltage control at the head of the recording material P (S14). Immediately after the head of the recording material P is plunged into the secondary transfer portion T2, the constant current control is hardly performed because the resistance of the secondary transfer portion T2 largely changes. Therefore, the constant voltage control is performed between immediately before and immediately after the recording material P is plunged into the secondary transfer portion T2.

In the paper leading-end constant voltage control (S14), a value Vtop (paper leading-end voltage) of the constant voltage applied to the secondary transfer roller 57 is set to Vtop=V1+Vp.

As illustrated in FIG. 10, a recording material divided voltage Vp (second voltage value) is a constant that is determined by the environmental temperature and humidity and the kind of the recording material, and is a voltage value that is shared by the dried recording material P in the secondary transfer portion T2.

As illustrated in FIG. 11A, the recording material divided voltage Vp is the voltage that is added to the control voltage V1 (paper absence portion voltage) in order to pass the target current It through the secondary transfer portion T2 when the dried, high-resistance recording material P passes through the secondary transfer portion T2. The voltage that is applied in order to pass the target current It to the secondary transfer portion T2 is the applied voltage V1 in the paper absence portion, and the voltage is the applied voltage V2 to V3 according to the hygroscopic degree (resistance) of the recording material when the recording material P exists.

The recording material divided voltage Vp is (paper presence portion voltage-paper absence portion voltage), and Vp=V3-V1 in Example 1.

The paper leading-end voltage Vtop used in the paper leading-end constant voltage control (S14) is equal to the paper presence portion voltage of the high-resistance paper. The high-resistance paper means a dried, nonhygroscopic recording material in which the resistance value of the thick toner image is added because of the high coverage rate. In Example 1, it is assumed that the high-resistance paper is an image ratio of 200% in which the toner image of two-color solid image is transferred to the whole surface of the recording material immediately after a recording material package is opened.

As illustrated in FIG. 10, the recording material divided voltage Vp is variably set according to the environmental temperature and humidity (absolute water amount). FIG. 10 illustrates the recording material divided voltages of the plain paper, cardboard, and glossy paper, however, in the control portion 15, recording material divided voltages are previously prepared in data tables for other kinds of recording materials and recording materials having different grammages.

Then the control portion 15 determines the lower limit voltage Vlimit (S15).

As illustrated in FIG. 11A, the lower limit voltage Vlimit is determined from the paper absence portion voltage V1 and the recording material divided voltage Vp by the following equation. In the equation, a factor C is set to 0.9 in Example 1.

$$V\text{limit}=C\times(V1+Vp)$$

Next, the control portion 15 performs in-paper constant current control (S16 to S19). In the in-paper constant current control, the constant current control is performed with the target current value It, and the control voltage V satisfying the current necessary to transfer the toner image is applied to the secondary transfer roller 57.

During the constant current control on the recording material, when the control voltage V is higher than the lower limit voltage Vlimit (YES in S17), the control voltage V is applied to the secondary transfer roller 57 (S18). On the other hand, when the control voltage V is lower than the lower limit voltage Vlimit in a calculation stage (NO in S17), the constant voltage of the lower limit voltage Vlimit is applied to the secondary transfer roller 57 (S19).

FIG. 11A illustrates experimental results of the voltage and current applied to the secondary transfer roller 57 in the secondary transfer portion T2 when the secondary transfer roller 57 in the new state is used. FIG. 11B illustrates experimental results of the voltage and current applied to the secondary transfer roller 57 in the secondary transfer portion T2 when the secondary transfer roller 57 at the end of life is used. As to environmental conditions, in both the cases, the temperature is set to 30° C., the humidity is set to 80%, and the recording material is plain paper.

As illustrated in FIG. 11B, because the lower limit voltage Vlimit is set according to the control voltage V1 in the state in which the recording material does not exist, the lower limit voltage Vlimit is properly set even if the secondary transfer roller 57 becomes the end of life by the accumulation of image formation. As described above with reference to FIG. 5B, since the lower limit voltage Vlimit is set lower than the control voltage V2 for the low-resistance paper, the control voltage V that is lower than the lower limit voltage Vlimit can be prevented from being applied to the low-resistance paper.

The control portion 15 then performs paper rear-end constant voltage control when the recording material P passes through the secondary transfer portion T2 (S20). For the similar reason that the paper leading-end constant voltage control (S14) is performed, the constant voltage control is performed because the constant current control is hardly performed immediately after the recording material P passes through the secondary transfer portion T2.

The control portion 15 performs inter-paper constant voltage control after the recording material P passes through the secondary transfer portion T2 (S21).

The processes in S14 to S21 are performed when the image is continuously formed (NO in S22), and the control is ended when there is no remaining image formation (YES in S22).

In Example 1, the test current is set equal to the target current. Alternatively, the test current may be a predetermined current value that is different from the target current.

Also, in Example 1, the control voltage of the constant current control using the test current is taken at every delivery intervals between the recording materials. Alternatively, the control voltage used to set the lower limit value may be taken in every other recording material or only at the head of the continuous image formation.

Further, in Example 1, the recording material divided voltage of the dried recording material varies according to the absolute water amount in the atmosphere. Alternatively, the recording material divided voltage may be set to one value in each kind of the recording material irrespective of the absolute water amount in the atmosphere.

COMPARATIVE EXAMPLE 1

Figure 12:
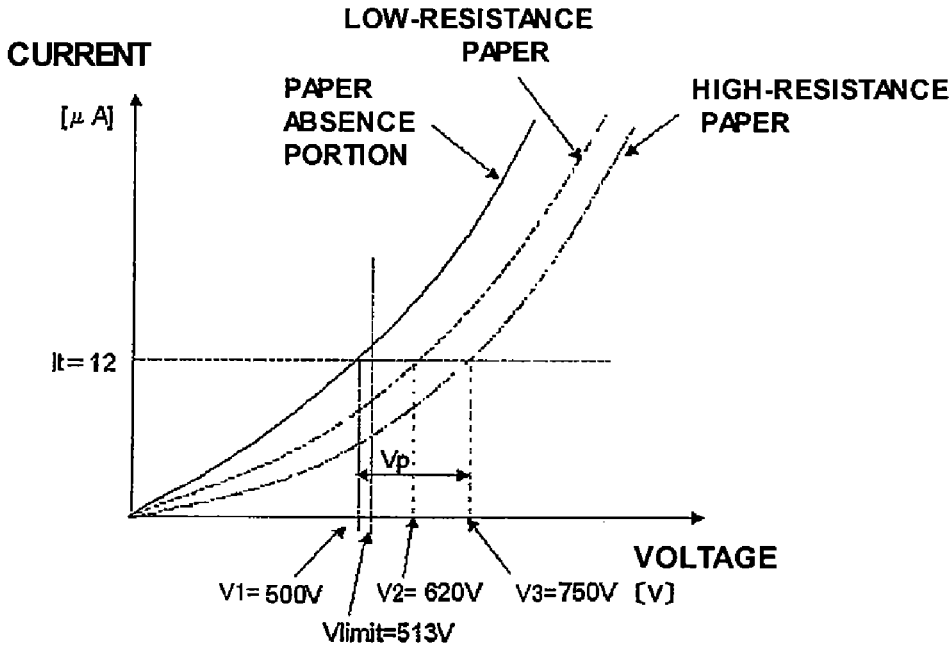
FIG. 12 illustrates control of Comparative Example 1.

FIG. 12 illustrates control of Comparative Example 1.

The control of comparative example 1 illustrates experimental results of the voltage and current applied to the secondary transfer roller 57 in the secondary transfer portion T2 when the secondary transfer roller 57 is used to the end of life while the lower limit voltage Vlimit is set to a fixed value of 513V. In FIG. 12, the environmental conditions and recording material P are identical to those of FIGS. 11A and 11B.

As illustrated in FIG. 11A, in Example 1, the lower limit voltage Vlimit is computed based on the paper absence portion voltage V1 and the recording material divided voltage Vp, and the lower limit voltage Vlimit becomes 513V. Therefore, the lower limit voltage Vlimit is higher than the paper presence portion voltage of 420V of the low-resistance paper, and the constant voltage control is performed with the lower limit voltage Vlimit to the low-resistance paper that absorbs the moisture to lower the resistance value. Because the current I2' of 17 μA that is higher than the target current It of 12 μA can be passed through the low-resistance paper, the loss generated by passing the current through the non-image portion can be compensated to prevent the transfer fault.

In the control of Comparative Example 1, the lower limit voltage Vlimit is also set to the fixed value of 513V, the constant voltage is similarly applied to pass the current I2' of 17 μA through the low-resistance paper, and the transfer fault is prevented.

As illustrated in FIG. 12, even if the resistance value of the secondary transfer roller 57 increases due to the accumulation of image formation, the lower limit voltage Vlimit does not increase according to the change in resistance value of the secondary transfer roller 57. Therefore, the lower limit voltage Vlimit becomes lower than the paper presence portion voltage of 620V of the low-resistance paper, and the constant current control is also performed to the low-resistance paper. As a result, a large amount of current is passed through the non-image portion to generate the transfer fault.

As illustrated in FIG. 11B, in the control of Example 1, because the lower limit voltage Vlimit is variably set based on the paper absence portion voltage V1 sampled in the last minute, the lower limit voltage Vlimit becomes 675V. The lower limit voltage Vlimit is higher than the paper presence portion voltage V2 of 620V of the low-resistance paper, and the constant voltage of the lower limit voltage Vlimit is applied to the low-resistance paper, so that the current I2' of 15 μA that is higher than the target current value It of 12 μA can be passed. Accordingly, the loss generated by passing the current through the non-image portion can be compensated to prevent the transfer fault.

COMPARATIVE EXAMPLE 2

Figure 13:
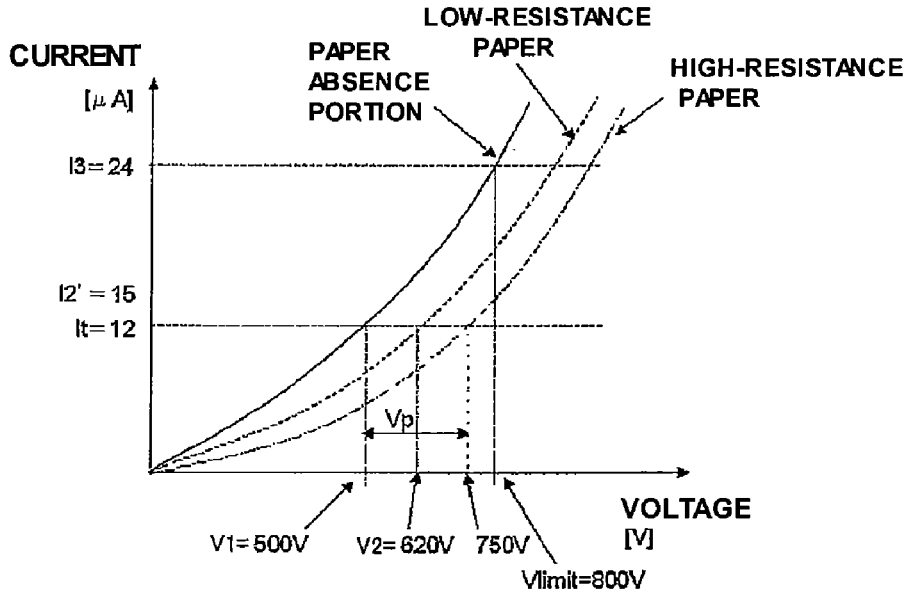
FIG. 13 illustrates control of Comparative Example 2.

FIG. 13 illustrates control of Comparative Example 2.

As illustrated in FIG. 13, in the control of Comparative Example 2, the lower limit voltage Vlimit is changed only by a measured value of the resistance value of the secondary transfer roller. In FIG. 13, the environmental conditions and recording material P are identical to those of FIGS. 11A and 11B.

As illustrated in FIG. 11A, when the lower limit voltage value Vlimit of 513V of Example 1 is applied to the secondary transfer roller 57 in the paper absence portion, the current value I3 of 24 μA is passed through the secondary transfer portion T2. In the control of comparative Example 2, the constant current control is performed with the target current It of 24 μA in the paper absence portion, and the control voltage V is sampled to set the lower limit voltage Vlimit as the control voltage V. Therefore, when the secondary transfer roller is in the new state, as with Example 1, the lower limit voltage value Vlimit is set to 513V, and then the lower limit voltage Vlimit is set so as to gradually increase according to the increase in resistance value of the secondary transfer roller 57.

As illustrated in FIG. 13, when the constant current control is performed with the target current It of 24 μA in the paper absence portion to set the lower limit voltage Vlimit while the resistance value of the secondary transfer roller 57 increases like Example 1, the lower limit voltage Vlimit is set to 800V.

At this point, because the lower limit voltage value Vlimit of 800V is higher than the paper presence portion voltage of 750V of the high-resistance paper, the constant voltage control is performed with the lower limit voltage value Vlimit of 800V to the high-resistance paper that is not necessary to apply the constant voltage. As a result, the current of 15 μA that is higher than the target current of 12 μA is passed through the high-resistance paper, and the transfer efficiency is lowered as illustrated in FIG. 7.

On the other hand, as illustrated in FIG. 11B, in the control of Example 1, the lower limit voltage Vlimit becomes 675V at the end of life of the secondary transfer roller, and the lower limit voltage Vlimit of 675V does not exceed the paper presence portion voltage of 750V of the high-resistance paper. Therefore, for the high-resistance paper, the optimum "voltage applied during the constant current control" can always supplied to the secondary transfer roller by the constant current control.

EXAMPLE 2

Figure 14:
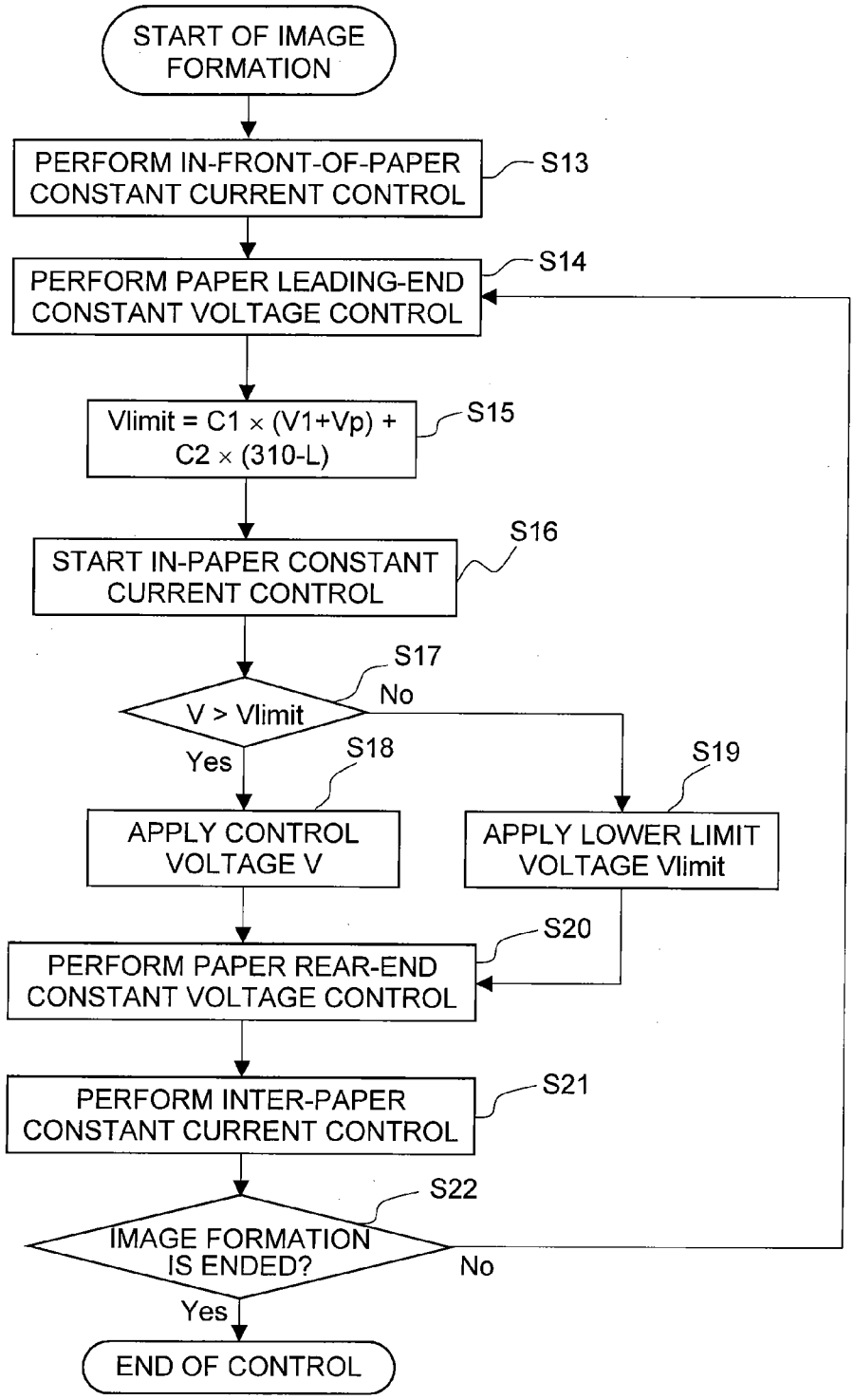
FIG. 14 is a flowchart illustrating control of a transfer voltage in Example 2.

FIG. 14 is a flowchart illustrating control of a transfer voltage in Example 2.

In the control of the flowchart of FIG. 14, the control similar to that of Example 1 is performed except for the mathematical formula relating to the setting of the lower limit voltage Vlimit in Step S15'. Accordingly, the processes in Steps S13 to S22 except for the process in Step S15' are designated by the common numerals in FIG. 9, and the overlapping description is omitted.

As illustrated in FIG. 14 as referring to FIG. 3, in Example 2, the lower limit voltage Vlimit to which the constant voltage is applied instead of the constant current control is also adjusted according to a length L of the recording material P in the longitudinal direction of the secondary transfer portion T2.

In the control of Example 2, as with the control of Example 1, the constant current control is performed with the target current It to the paper absence portion in the last minute to sample the "voltage V1 applied during the constant current control" (S13).

Using the following the equation, the control portion 15 sets the lower limit voltage Vlimit according to the paper absence portion voltage V1, the recording material divided voltage Vp, and the length L (unit: mm) of the recording material P (S15').

$$Vlimit=C1\times(V1+Vp)+C2\times(310-L)$$

In Example 2, a factor C1 is set to 0.85, and a factor C2 is set to 1.5.

When the recording material P passing through the secondary transfer portion T2 has the small length (L), a large amount of current is passed through the paper non-passing portion outside the recording material. In Example 2, the magnitude of the lower limit voltage Vlimit increases as the length (L) of the recording material P decreases, and the constant voltage is applied even if the hygroscopic amount of the recording material P is not so large to increase the transfer current. Therefore, the current shortage for the image portion is compensated to prevent the transfer fault.

EXAMPLE 3

Figure 15:
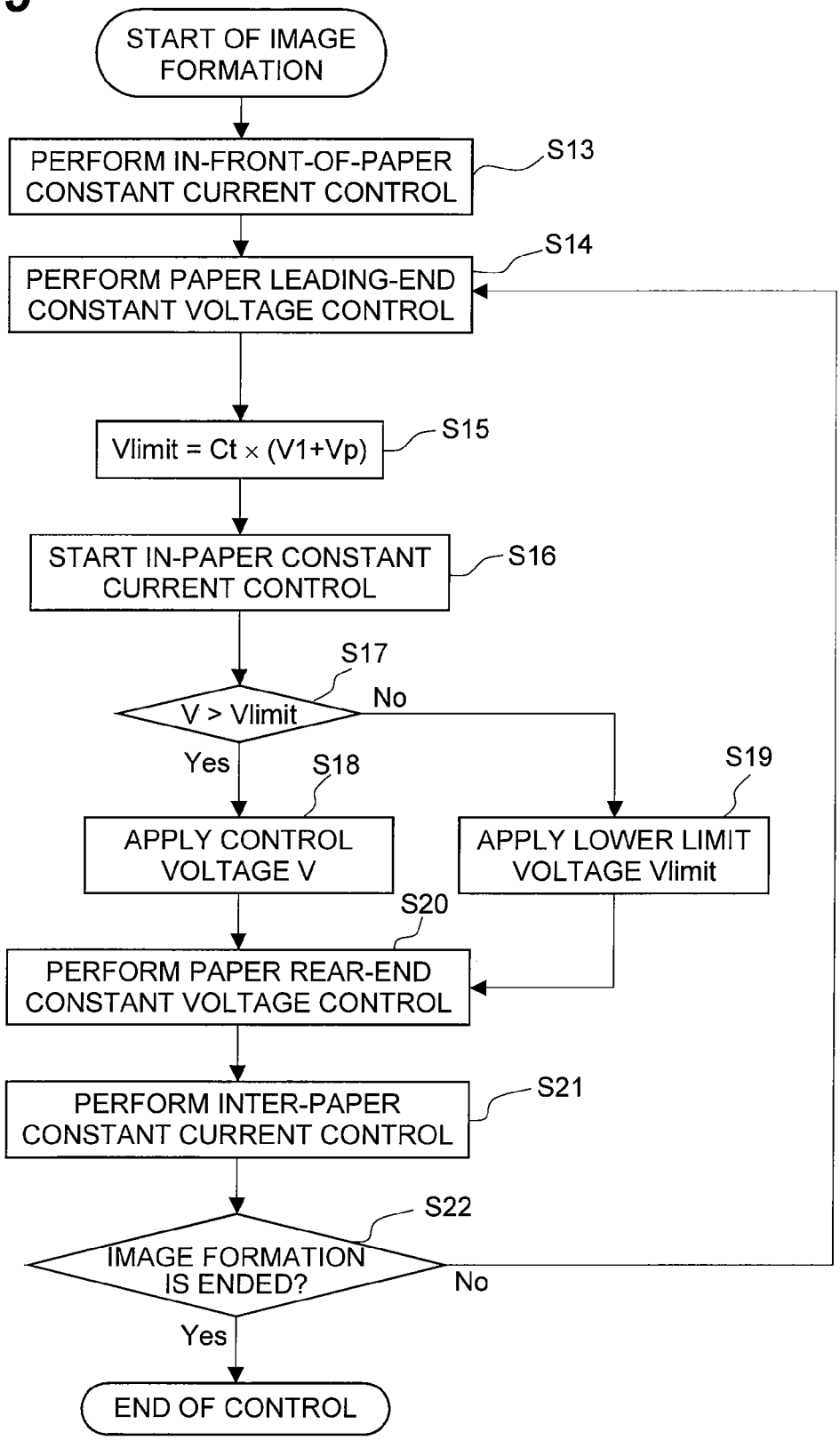
FIG. 15 is a flowchart illustrating control of a transfer voltage in Example 3.
Figure 16:
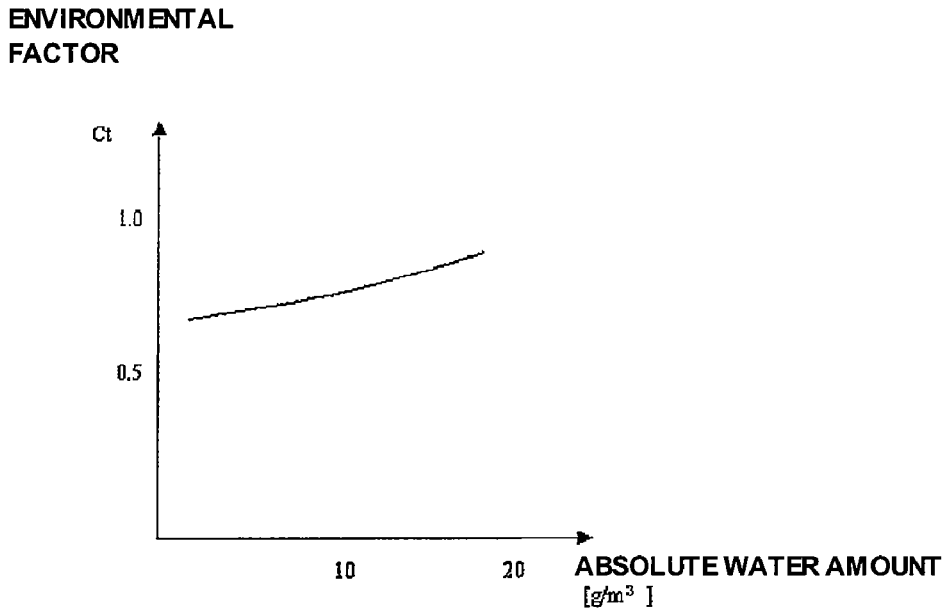
FIG. 16 illustrates an environmental factor.

FIG. 15 is a flowchart illustrating control of a transfer voltage in Example 3, and FIG. 16 illustrates an environmental factor.

In the control of the flowchart of FIG. 15, the control similar to that of Example 1 is performed except for the mathematical formula relating to the setting of the lower limit voltage Vlimit in Step S15". Accordingly, the processes in Steps S13 to S22 except for the process in Step S15" are designated by the common numerals in FIG. 9, and the overlapping description is omitted.

As illustrated in FIG. 15 as referring to FIGS. 3, in Example 3, the lower limit voltage Vlimit to which the constant voltage is applied instead of the constant current control is also adjusted according to an environmental factor Ct that is selected from a data table of FIG. 16 based on the output of the environmental sensor 17.

In the controls of Example 3, as with the control of Example 1, the constant current control is performed with the target current It to the paper absence portion in the last minute to sample the control voltage V1 applied during the constant current control (S13).

Using the following the equation, the control portion 15 sets the lower limit voltage Vlimit according to the paper absence portion voltage V1, the recording material divided voltage Vp, and the environmental factor Ct (S15").

$$Vlimit=Ct\times(V1+Vp)$$

The environmental factor Ct is determined by the temperature and humidity, which are detected by the environmental sensor 17, and is stored in the control portion 15 as the data table in which the relationship with the absolute water amount is defined as illustrated in FIG. 16.

The environmental factor Ct increases and comes close to 1.0 with increasing absolute water amount in the atmosphere.

As illustrated in FIG. 4A, because the hygroscopic amount of the recording material P decreases with decreasing absolute water amount in the atmosphere, the difference between the current passed through the image portion and the current passed through the non-image portion decreases to lower the need for applying the constant voltage with the lower limit voltage Vlimit. Therefore, in Example 3, the constant current control is applied as much as possible except for the high-temperature and high-humidity environment of FIG. 4B, and the difference between the lower limit voltage Vlimit and the paper presence portion voltage V3 (FIG. 11A) increases with decreasing absolute water amount.

As a result, the switch to the constant voltage control with the lower limit voltage Vlimit is easily made as the environment comes close to the high-temperature and high-humidity environment in which the constant voltage control is required, and the switch to the constant voltage control with the lower limit voltage Vlimit is hardly made as the environment comes close to the low-temperature and low-humidity environment in which the constant current control is required.

As described above, according to the control of Examples 1 to 3, the lower limit value Vlimit of the control voltage V changes by the measured resistance value of the transfer member. Therefore, even if the resistance of the transfer member increases by the energization accumulation, when the recording material has the small resistance value in the high-temperature and high-humidity environment, the switch to the constant voltage control with the lower limit value Vlimit is securely made to prevent the transfer fault.

Also, the lower limit value Vlimit of the control voltage V is determined in consideration of the kind of the recording material and the absolute water amount in the atmosphere, so that the constant current control can securely be applied when the recording material has the high resistance value.

According to the control of Example 2, because the lower limit voltage Vlimit increases with decreasing length of the recording material, the current necessary for the transfer to the image portion can be secured even if a large amount of current is passed through the paper non-passing portion.

According to the control of Example 3, the lower limit voltage Vlimit changes based on the absolute water amount in the atmosphere, the switch to the constant voltage control with the lower limit voltage Vlimit is easily made as the environment comes close to the high-temperature and high-humidity environment.

EXAMPLE 4

In the image forming apparatus of Examples 1 to 3, the toner image of the image bearing member is formed by the toner image forming unit, is then transferred to the intermediate transfer member, and is transferred from the intermediate transfer member to the recording material by the transfer portion in which the transfer member is used.

The invention, however, can also be implemented in an image forming apparatus wherein the image-bearing-member toner image formed by the toner image forming unit is transferred from the image bearing member to the recording material by the transfer portion in which the transfer member is used.

That is, the invention can also be implemented in a monochrome printer wherein the toner image formed by performing the charging, exposure, and development to the photosensitive drum is transferred to the recording material by the transfer portion in which the transfer member is used.

As with the control of Examples 1 to 3, the "voltage applied during the constant current control" can be provided before the recording material reaches the transfer portion. Then, in the process in which the recording material passes through the transfer portion, the control voltage applied during the constant current control can be provided in the voltage range where the constant voltage output that changes according to the "voltage applied during the constant current control" before the recording material reaches the transfer portion and the kind of the recording material is set to the lower limit value. Therefore, the application of the control voltage applied during the constant current control using the lower limit voltage Vlimit and the application of the constant voltage of the lower limit voltage Vlimit can separately be performed.

As described above, the invention can enhance the transfer stability when the voltage to which the constant current control is performed reaches the lower limit voltage even if the electric characteristics of the transfer member and the kind of the recording material change.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-036685, filed Feb. 19, 2009, which is hereby incorporated by reference herein in its entirety.

What is claimed is:

1. An image forming apparatus comprising:

an image bearing member;

a toner image forming unit that forms a toner image on the image bearing member;

a transfer member that forms a transfer portion, the transfer portion transferring the toner image from the image bearing member to a recording material;

a control unit that performs constant current control in a transfer process such that an amount of current passing through the transfer member becomes a previously set target current value in a voltage range, a lower limit voltage that becomes a lower limit of an absolute value of a voltage applied to the transfer member being set in the voltage range; and a setting portion that sets the lower limit voltage based on a value obtained by adding a first voltage value and a second voltage value, the first voltage value being set by applying a voltage to the transfer member in a state in which the recording material does not exist at the transfer member, the second voltage value being set according to the recording material.

2. The image forming apparatus according to claim 1, wherein the first voltage value is a voltage value in which a current of the target current value is passed.

3. The image forming apparatus according to claim 1, wherein the lower limit voltage is set by multiplying a predetermined ratio by addition of a voltage value previously set according to a kind of the recording material and a voltage value in which a current value identical to the constant current value during the transfer process in the state, in which the recording material does not exist in the transfer portion, is passed through the transfer member.

4. The image forming apparatus according to claim 1, wherein the control unit starts the constant current control with the predetermined target current after the lower limit voltage is applied to a leading end of the recording material.

5. The image forming apparatus according to claim 1, further comprising a determination unit that determines a length of the recording material in a longitudinal direction of the transfer portion, wherein the absolute value of the lower limit voltage increases with shortening length of the recording material.

6. The image forming apparatus according to claim 1, further comprising a determination unit that determines an absolute water amount in the atmosphere, wherein the absolute value of the lower limit voltage increases with increasing absolute water amount in the atmosphere.

* * * * *